US006496094B2

(12) United States Patent
May, III

(10) Patent No.: US 6,496,094 B2
(45) Date of Patent: Dec. 17, 2002

(54) MAGNET CLAMP FOR HAND TOOLS

(76) Inventor: Otho D May, III, 114 Buffington St., Saluda, SC (US) 29138

( * ) Notice: Subject to any disclaimer, the term of this patent is extended or adjusted under 35 U.S.C. 154(b) by 0 days.

(21) Appl. No.: 09/774,478

(22) Filed: Jan. 30, 2001

(65) Prior Publication Data

US 2002/0101311 A1 Aug. 1, 2002

(51) Int. Cl.[7] ..... A47F 7/00; H01F 7/20

(52) U.S. Cl. ..... 335/285; 211/69; 224/183; 224/901.2; 224/901.4; 224/901.6

(58) Field of Search ..... 335/285; 211/69; 224/183, 901, 901.2, 901.4, 901.6

(56) References Cited

U.S. PATENT DOCUMENTS

| | | | | |
|---|---|---|---|---|
| 2,176,052 A | * | 10/1939 | Beyer | 132/331 |
| 3,755,857 A | * | 9/1973 | Simoneaux | 132/331 |
| 4,530,263 A | | 7/1985 | Muntel | |
| 4,601,823 A | | 7/1986 | Beck | |
| 4,652,845 A | | 3/1987 | Finkle | |
| D317,730 S | * | 6/1991 | Mo | 224/183 |
| D317,813 S | * | 6/1991 | Ellison et al. | D23/207 |
| 5,056,969 A | | 10/1991 | Nerland et al. | |
| 5,063,368 A | * | 11/1991 | Ettehadieh | 123/538 |
| 5,130,899 A | * | 7/1992 | Larkin et al. | 224/183 |
| 5,346,453 A | | 9/1994 | Rivera-bottzeck | |
| 5,462,392 A | | 10/1995 | Hardwick | |
| 5,544,396 A | | 8/1996 | Mekyska | |
| 5,603,248 A | * | 2/1997 | Eggert et al. | 81/125 |
| 5,609,298 A | | 3/1997 | Hyslop | |
| 5,842,584 A | | 12/1998 | Baird | |

OTHER PUBLICATIONS http://www.simongruppe.de/eng/k1/2000155.html for Magnetic Catch With Clamp Magnet, No Date.
http://www.simongruppe.de/eng/k1/2000271.html for Drill–Inn Magnetic Catch With Clamp Magnet, No Date.
http://home.vicnet.net.au/~pwguild/gd–ideal.htm for Now That's A Good Idea!, no date.

* cited by examiner

*Primary Examiner*—Ramon M. Barrera
(74) *Attorney, Agent, or Firm*—Michael A. Mann; Sara A. Centioni; Nexsen Pruet Jacobs and Pollard, LLC

(57) ABSTRACT

A magnet clamp for use with a hand tool is disclosed. The present invention provides a magnet that can be reversibly attached to an existing commercially-available hand-held tool without modification of the tool, thereby providing a way to securely hold various small metal items associated with said hand tool, while making said items readily available for use. Drill bits, saw blades, nails, screws, bolts, tacks, chuck keys, or any small objects made of or alloyed with a ferromagnetic substance such as iron or steel may be securely held by the present invention. The present invention also provides a simple and inexpensive process of manufacturing such a device from common items, including an automotive hose clamp, and from common operations, such as soldering and gluing.

7 Claims, 3 Drawing Sheets

MAGNET CLAMP FOR HAND TOOLS

1. Field of the Invention

The present invention relates to hand-held tools, also referred to as hand tools. In particular, the present invention is a device that uses a magnet to achieve the storage and ready accessibility of small items associated with said tool and that may be easily attached to almost any commercially available hand tool.

2. Background of the Invention

Whether for relaxation, vocation, or out of necessity, great numbers of people each day perform construction or repair work using hand tools. Hand tools such as drills, saws, hammers, screwdrivers, wrenches, and other portable tools are commonly used both at work and in hobbies. Associated with these tools are small items such as bits, blades, nails, screws, bolts, tacks, and chuck keys; the need for such items necessarily leads to the difficulty of retaining small related items. Considerable frustration is created, and valuable minutes are lost, when a tool user must stop his or her activities in order to search for a misplaced or dropped small item.

Frequently, these small items are critical to the hand tool's operation and performance. For instance, a reciprocal saw is useless without a blade; if the blade breaks and no readily spare blade can be found, the tool cannot be used. Likewise, a drill that uses interchangeable bits loses its adaptability if the chuck key is lost. Moreover, some of these small objects are not easily replaced at a local store, but must instead be ordered from the tool manufacturer. A device or system that would enable the user of hand tools to account for such critical small items would save both time and expense.

Many times, these small items may be inexpensive and easy to replace. However, it is no consolation that another drill bit or screw can be purchased to replace the one that was just dropped, when the nearest hardware store is miles from the worksite, and the construction cannot be completed without the required object. Therefore, much time can be saved and much frustration avoided with a device or system that would enable the user of hand tools to account for such small items.

Tool users have attempted to address the aforementioned difficulties in a variety of ways. Many try to store the items in their original containers; however, this rarely solves the problem, since most containers are not resealable. This leads again to losing the items. Even if the containers succeed in retaining the items, the user will frequently accumulate numerous containers that must be accounted for. As an alternative, the users can store the items in another box or bag, but this also leads to the multiple container problem. Moreover, the bags and boxes are usually not the optimum size or shape for holding the tool accessories. Additionally, the items are not readily available for use, but instead must be retrieved from storage before use.

Perhaps the most common—but not the most helpful—method of storing these accessories is the "throw them in the toolbox" method. The product of this strategy is a disorganized pile that must be searched each time an item is desired. Moreover, a toolbox is generally heavy, thereby disadvantaging a user when carrying and retrieving items while working.

A review of the prior art devices shows four devices that attempt to solve the foregoing difficulties associated with tools and related accessories.

U.S. Pat. No. 4,530,263 discloses a holder for lathe tools.

U.S. Pat. No. 4,652,845 discloses a magnetic holding device to be mounted to a magnetizable surface.

U.S. Pat. No. 5,544,396 discloses a holder for securing objects using a jaw-clamp.

U.S. Pat. No. 5,842,584 discloses a belt for storing elongated objects.

However, none of the prior art devices solves all the aforementioned difficulties in a simple and inexpensive manner. Thus, there exists considerable need for a device and method for storing hand tool accessories and other associated items that makes said items readily available to the user during construction or repairs, without the foregoing limitations.

SUMMARY OF THE INVENTION

According to its major aspects and briefly described, the present invention is a magnetic plate that can be attached to a hand tool. The magnetic plate serves as a small work surface on which the small parts that the tool user needs for a job can be placed and where they will stay until the user is ready to use them. Such a magnetic plate can be used to solve the problems and difficulties aforementioned.

An important advantage of the present invention for hand tools that are portable, battery operated, electric tools is that it makes them truly portable. Having the present invention attached to such a tool allows the user to carry all the small parts needed for a job on the magnetic attachment.

A feature of the present invention is the use of a magnet carried by the hand tool to hold small parts needed in using the hand tool. This feature makes it easy to keep these small parts where needed and conveniently accessible to the tool user.

Using an adjustable band to secure the magnet to the hand tool is another feature of the present invention. This feature allows the magnet to be easily and quickly attached to the hand tool.

Other features and their advantages will be apparent to those skilled in the manufacture and use of containers from inspection of the drawings or careful reading of the Detailed Description of Preferred Embodiments.

DETAILED DESCRIPTION OF PREFERRED EMBODIMENTS

The invention is a magnet that can be attached to a hand tool, thereby providing a device that securely holds various small items associated with a hand tool while making said items readily available for use. In the vast majority of cases, these small items are formed of metal; consequently, magnetic attraction is an ideal method for affixing these accessories in place. Examples of such items are drill bits, saw blades, nails, screws, bolts, tacks, and chuck keys. However, any small object formed from a ferromagnetic substance such as iron or steel may be securely held by the present invention.

Figure 1A:
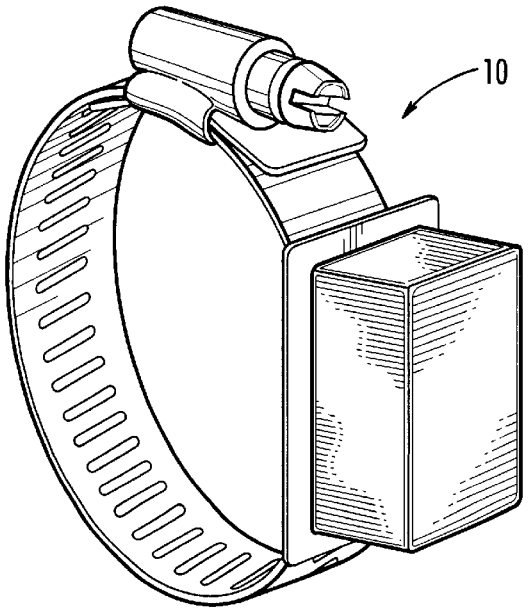
FIG. 1A is a front perspective view of a preferred embodiment of the present invention.
Figure 1B:
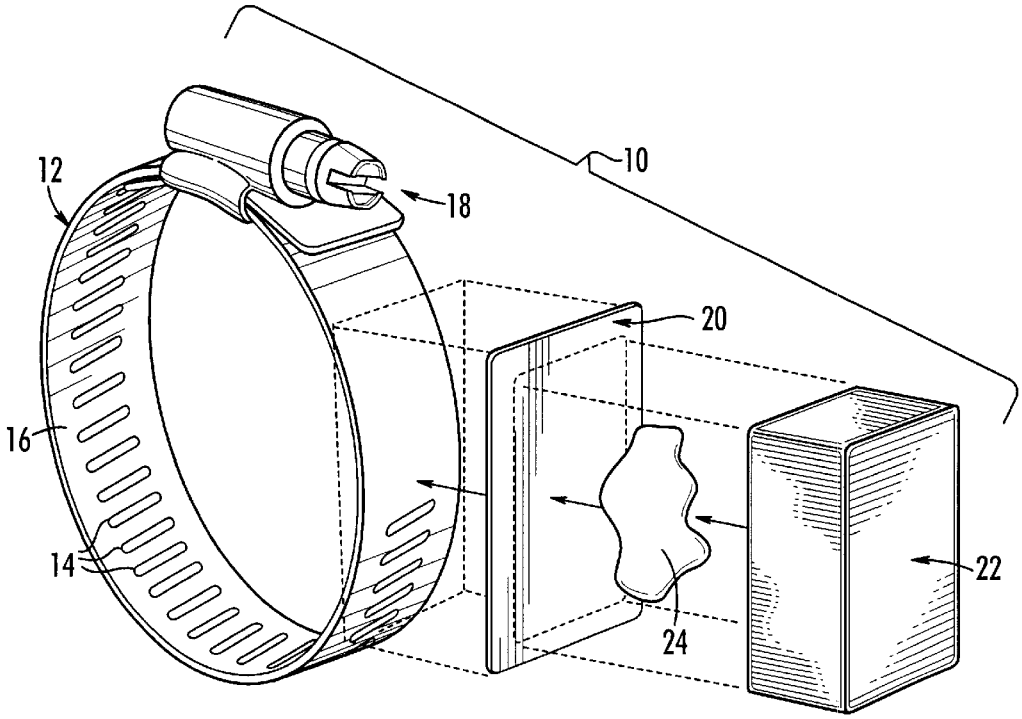
FIG. 1B is an exploded view of a preferred embodiment of the present invention.

Referring now to FIG. 1A, there is shown a magnet clamp 10. In FIG. 1B, the individual parts comprising magnet clamp 10 are shown. The invention has flexible band 12 that allows the device to encircle a hand tool. Band 12 is dimensioned so as to snugly encircle the desired hand-held tool. Preferably, band 12 is an automotive hose clamp, and the size can be selected from the wide variety of commercially-available hose clamps. The clamp, and thus band 12, may be formed of aluminum, iron, steel, polytetrafluoroethylene, polyethylene, or polypropylene; however, this list is not exclusive and band can be made of other common materials, such as leather, rubber, vinyl, or nylon, or any other material that can be used in the manufacture of bands, belts, or clamps. Essentially, band 12 is a flat ring with a means for adjusting its cross-section. In the most preferred embodiment, the adjustment means is serrated strip 14, carrying serially disposed serrations 16 at the first end of band 12, along with a tightening screw 18 at the second end. Serrations 16 may be canals or slots in the material of band 12, or may be raised bumps or ridges on the surface of band 12. Screw 18 is attached to the second end of band 12, but may freely rotate. Further, serrations 16 and screw 18 are selected and dimensioned so as to threadingly engage each other. Moreover, when serrations 16 and screw 18 are so engaged, rotation of screw 18 results in the successive engagement of serrations 16 along the length of serrated strip 14, thereby adjusting the cross-sectional size of band 12. Screw 18 can also have a wing-head so as to facilitate rotation without the need for a wrench or screwdriver. Although the adjustment means of the present invention is preferably serrations 16 and screw 18, alternate closure and adjustment means may be used. Hook-and-loop closures, such as VELCRO, are one example, but any closure means known to the practitioners of the art of manufacturing and using hose clamps may be used in the present invention without departing from its scope.

Attached to the outside surface of band 12 is plate 20, consisting of a simple single piece of metal and formed in one of a variety of possible shapes. Most preferably, plate 20 is flat and rectangular, but can be arcuate or other shape to conform with the tool, object, or surface that band 12 encircles. Plate 20 is preferably attached to band 12 by solder; however, other well-known methods of metal-to-metal attachment used by practitioners of metal-working can be used to attach band 12 to plate 20 without departing from the scope of the present invention.

Attached to plate 20 is magnet 22. Magnet 22 comprises a magnetic substance, such as a metal alloy of Aluminum-Nickel-Cobalt (Alnicos), a ceramic of Strontium-Iron (Ferrites), Neodymium-Iron-Boron (Neo magnets), or Samarium-Cobalt. Preferably, magnet 22 is made of a Ferrite ceramic. Magnet 22 is mounted to the outside surface of plate 20 with epoxy 24, but other glues or attachment methods may be used. Plate 20 is necessary in the present invention because magnet 22 preferably consists of a non-metallic ceramic substance and, thus, cannot be directly soldered to band 12.

Figure 2:
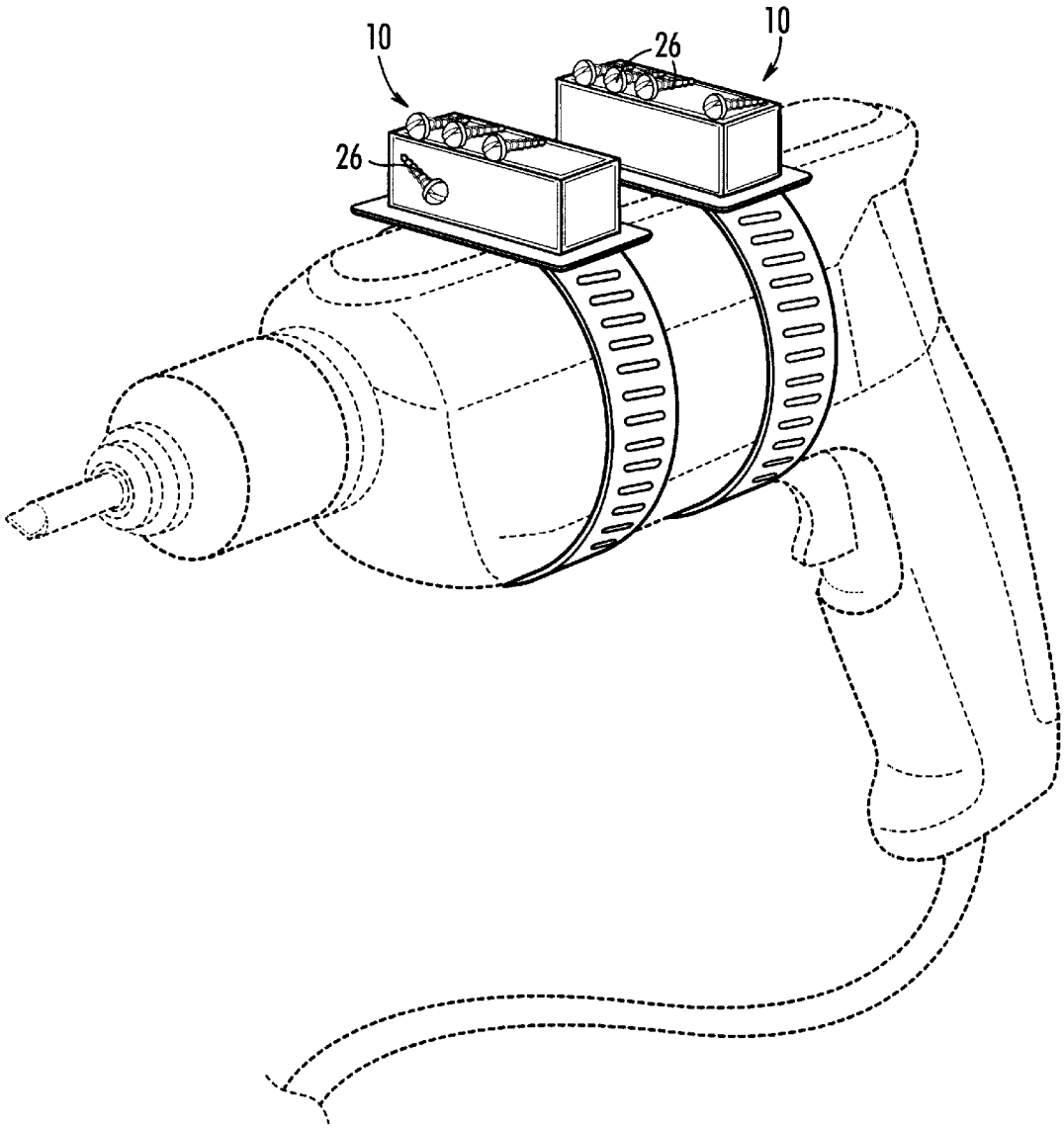
FIG. 2 is an environment view of a preferred embodiment of the present invention in combination with a hand-held power drill.

Referring now to FIG. 2, there is shown the presently disclosed magnet clamp 10 in combination with a hand tool. As depicted, more than one device can be used with a hand tool. Also shown are small metal items 26 held securely by magnet clamp 10. Here, a hand-held power drill is shown, but other hand tools, such as jigsaws, screwdrivers, wrenches, and other portable tools may also be used with the invention.

Figure 3:
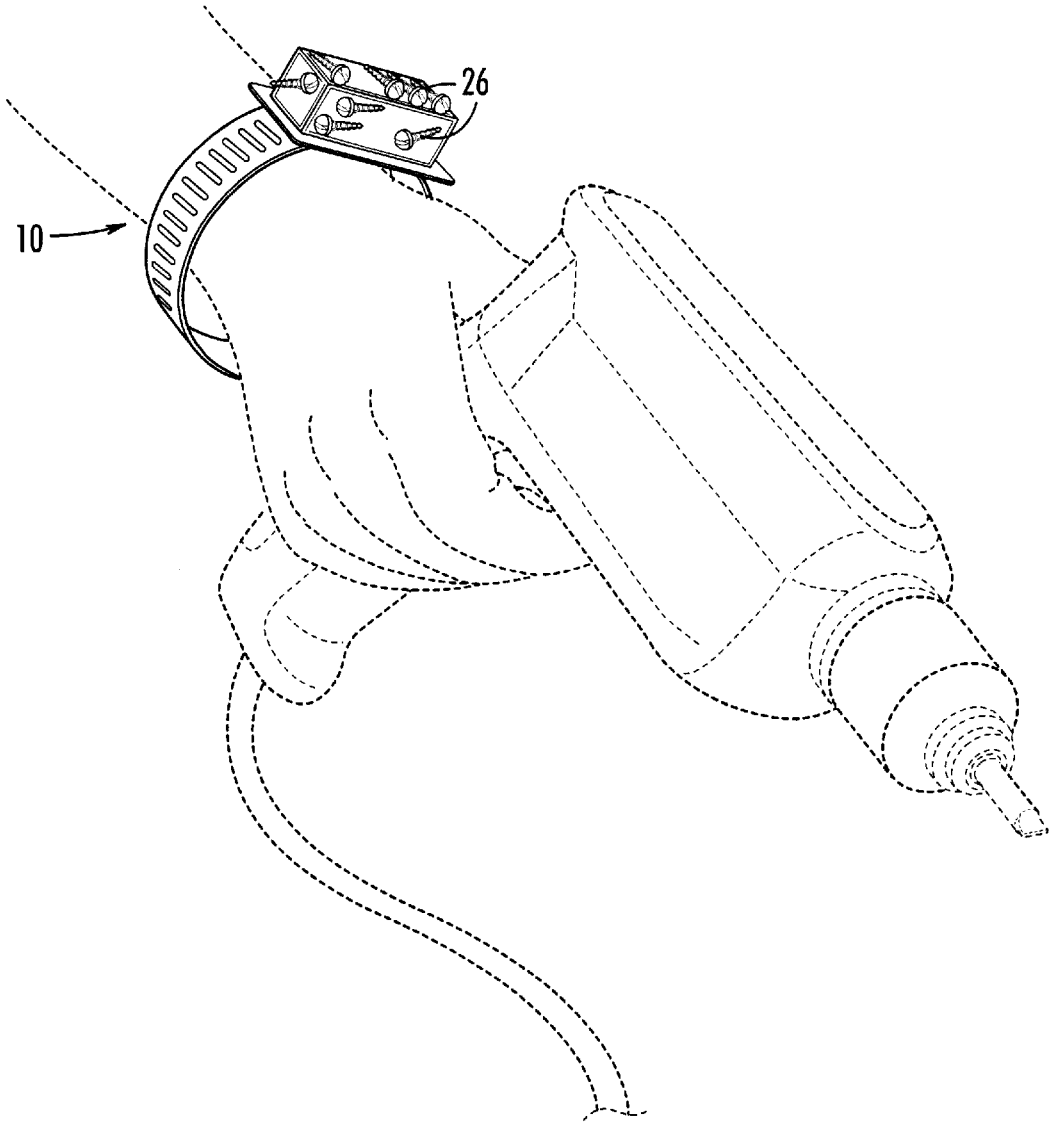
FIG. 3 is an environment view of a preferred embodiment of the present invention in an alternate application.

Referring now to FIG. 3, the present invention is shown in an alternate application. Here, the device loosely encircles the wrist of the hand tool user. In this application, the user can enjoy all of the foregoing advantages while gaining the flexibility of being able to switch hand tools and maintain the associated small metal items 26 at ready. Moreover, the present invention is not limited to use on a hand tool or wrist, but may also be clamped to any other suitably dimensioned object. For example, the device can be attached to a fence-post or signpost, a broom, a chair or table, a workbench, or a toolbox. By appropriate choice of size of the hose clamp used in the instant invention, the device may be used in combination with virtually any object associated with hand tools.

The invention is also a process of manufacturing a device according to the foregoing preferred embodiment of the present invention; this process has the dual advantages of being simple and inexpensive. Moreover, no modification is needed for an existing commercially-available hand tool in order to use the present invention. The assembly begins by choosing an automotive hose clamp that is appropriate for the selected hand tool. Automotive hose clamps are simple devices that are both common and inexpensive. An appropriate clamp has band 12 with a circumference that is dimensioned to slightly larger than the selected hand tool and has an adjustment means consisting of serrations 16 and tightening screw 18. When serrations 16 and screw 18 are threadingly engaged, rotation of screw 18 adjusts the cross-sectional size of band 12 to snugly encircle the selected hand tool. The next step in the process is attaching plate 20 to band 12. Preferably, the attachment means is solder, but any attachment means commonly used to bind metal surfaces, such as welding or gluing, can be used. Plate 20 is soldered to the outside surface of band 12 in a position that does not interfere with the operation of serrations 16 and screw 18. The last step in the process is mounting magnet 22 to plate 20. Preferably, epoxy glue is used to attach magnet 22 to the outer surface of plate 20. However, gluing is not the only method of attaching magnet 22 to plate 20; there are many means of mounting that may be used without departing from the scope of the instant invention. The resulting device is then mounted on the selected hand tool by encircling the tool with band 12 and tightening screw 18 so as to decrease the clamp's cross-sectional size and to snugly fit said hand tool. Magnet 22 is thereby affixed to the selected hand tool, and the device may now securely hold small metal items 26.

Magnet 22 can be also be carried by the tool by being attached directly to the housing at a convenient spot so that small metal items 26 can be temporarily held to the housing until needed.

It will be apparent to those skilled in the art of manufacturing and using clamps or hand tools that many modifications and substitutions can be made to the foregoing preferred embodiments without departing from the spirit and scope of the present invention, defined by the appended claims.

LIST OF REFERENCE NUMBERS magnet clamp, generally . . . 10
band . . . 12
serrated strip . . . 14
serrations . . . 16
screw . . . 18
plate . . . 20
magnet . . . 22
epoxy . . . 24
small metal item(s) . . . 26

What is claimed is:

1. A device, comprising:

a hand tool; and a magnet carried by a band that encircles said hand tool, said band having a first end and a second end and wherein said band carries an adjustment means for providing cross-sectional adjustment of said band, said adjustment means comprising:

a serrated strip having serially disposed serrations, said serrated strip connected to said first end of said band; and a tightening screw connected with said second end of said band for threadingly engaging said serrations to thereby provide said cross-sectional adjustment.

2. The device as recited in claim 1, wherein said band is made of a material selected from the group consisting of aluminum, iron, steel, polytetrafluoroethylene, polyethylene, and polypropylene.

3. The device as recited in claim 1, wherein said band is made of a material selected from the group consisting of leather, rubber, vinyl, and nylon.

4. A process for affixing a magnet to a hand tool, said process comprising the steps of:

attaching a plate to a hose clamp;

mounting a magnet on said plate;

encircling said hand tool with said hose clamp; and tightening said hose clamp so as to prevent movement of said hose clamp relative to said hand tool.

5. The process recited in claim 4, wherein said attaching step further comprises the step of soldering said plate to said hose clamp.

6. The process recited in claim 4, wherein said mounting step further comprises the step of adhering said magnet to said plate with an epoxy resin.

7. The process recited in claim 4, wherein said hose clamp carries a tightening screw having a wing-head.

* * * * *